US005904736A

United States Patent [19]

Maurer et al.

[11] Patent Number: 5,904,736

[45] Date of Patent: May 18, 1999

[54] CELLULASE-CONTAINING WASHING AGENTS

[75] Inventors: Karl-Heinz Maurer, Erkrath; Albrecht Weiss, Langenfeld, both of Germany

[73] Assignee: Henkel Kommanditgesellschaft auf Aktien, Duesseldorf, Germany

[21] Appl. No.: 08/930,124

[22] PCT Filed: Apr. 18, 1996

[86] PCT No.: PCT/EP96/01616

§ 371 Date: Nov. 21, 1997

§ 102(e) Date: Nov. 21, 1997

[87] PCT Pub. No.: WO96/34080

PCT Pub. Date: Oct. 31, 1996

[30] Foreign Application Priority Data

Apr. 28, 1995 [DE] Germany ..... 195 15 072

[51] Int. Cl.[6] ..... C11D 3/386; D06B 1/00

[52] U.S. Cl. ..... 8/137; 510/320; 510/321; 510/392; 510/226; 510/530; 8/401

[58] Field of Search ..... 510/320, 321, 510/392, 226, 530; 8/137, 401

[56] References Cited

U.S. PATENT DOCUMENTS

| | | | |
|---|---|---|---|
| 1,985,424 | 12/1934 | Piggott | 260/124 |
| 2,016,962 | 10/1935 | Flint et al. | 260/127 |
| 2,703,798 | 3/1955 | Schwartz | 260/211 |

(List continued on next page.)

FOREIGN PATENT DOCUMENTS

| | | |
|---|---|---|
| 923069 | 3/1973 | Canada . |
| 1 036 455 | 8/1978 | Canada . |
| 0 006 638 | 1/1980 | European Pat. Off. . |
| 0 028 865 | 5/1981 | European Pat. Off. . |
| 0 037 026 | 10/1981 | European Pat. Off. . |
| 0 080 223 | 6/1983 | European Pat. Off. . |
| 0 080 748 | 6/1983 | European Pat. Off. . |
| 0 092 355 | 10/1983 | European Pat. Off. . |
| 0 117 553 | 9/1984 | European Pat. Off. . |
| 0 130 064 | 1/1985 | European Pat. Off. . |
| 0 150 386 | 8/1985 | European Pat. Off. . |
| 0 164 514 | 12/1985 | European Pat. Off. . |
| 0 164 552 | 12/1985 | European Pat. Off. . |
| 0 167 309 | 1/1986 | European Pat. Off. . |
| 0 204 284 | 12/1986 | European Pat. Off. . |
| 0 214 761 | 3/1987 | European Pat. Off. . |
| 0 218 272 | 4/1987 | European Pat. Off. . |
| 0 220 016 | 4/1987 | European Pat. Off. . |
| 0 258 068 | 3/1988 | European Pat. Off. . |
| 0 262 588 | 4/1988 | European Pat. Off. . |
| 0 269 168 | 6/1988 | European Pat. Off. . |
| 0 294 753 | 12/1988 | European Pat. Off. . |
| 0 301 298 | 2/1989 | European Pat. Off. . |
| 0 301 414 | 2/1989 | European Pat. Off. . |
| 0 305 216 | 3/1989 | European Pat. Off. . |
| 0 309 931 | 4/1989 | European Pat. Off. . |
| 0 330 641 | 8/1989 | European Pat. Off. . |
| 0 331 376 | 9/1989 | European Pat. Off. . |
| 0 334 462 | 9/1989 | European Pat. Off. . |
| 0 339 550 | 11/1989 | European Pat. Off. . |
| 0 341 947 | 11/1989 | European Pat. Off. . |
| 0 350 098 | 1/1990 | European Pat. Off. . |
| 0 357 969 | 3/1990 | European Pat. Off. . |
| 0 362 671 | 4/1990 | European Pat. Off. . |
| 0 375 102 | 6/1990 | European Pat. Off. . |
| 0 376 705 | 7/1990 | European Pat. Off. . |
| 0 378 261 | 7/1990 | European Pat. Off. . |
| 0 378 262 | 7/1990 | European Pat. Off. . |
| 0 384 717 | 8/1990 | European Pat. Off. . |
| 0 385 401 | 9/1990 | European Pat. Off. . |
| 0 425 427 | 5/1991 | European Pat. Off. . |
| 0 425 428 | 5/1991 | European Pat. Off. . |
| 0 436 835 | 7/1991 | European Pat. Off. . |
| 0 451 924 | 10/1991 | European Pat. Off. . |
| 0 468 102 | 1/1992 | European Pat. Off. . |
| 0 502 325 | 9/1992 | European Pat. Off. . |
| 0 511 456 | 11/1992 | European Pat. Off. . |
| 0 548 599 | 6/1993 | European Pat. Off. . |
| 0 583 536 | 2/1994 | European Pat. Off. . |
| 19 40 488 | 2/1971 | Germany . |
| 20 44 161 | 4/1971 | Germany . |
| 21 01 803 | 7/1971 | Germany . |
| 21 48 278 | 3/1972 | Germany . |
| 21 21 397 | 11/1972 | Germany . |
| 22 47 832 | 4/1973 | Germany . |
| 24 12 837 | 10/1974 | Germany . |
| 31 17 250 | 4/1982 | Germany . |
| 32 07 825 | 9/1982 | Germany . |
| 34 36 194 | 4/1986 | Germany . |
| 0 255 884 | 4/1988 | Germany . |
| 42 21 381 | 2/1994 | Germany . |
| 43 00 772 | 7/1994 | Germany . |
| 4/238809 | 8/1992 | Japan . |
| 4/260610 | 9/1992 | Japan . |
| 1 263 765 | 2/1972 | United Kingdom . |
| 2 095 275 | 9/1982 | United Kingdom . |
| WO89/09259 | 10/1989 | WIPO . |
| WO90/10695 | 9/1990 | WIPO . |
| WO90/13533 | 11/1990 | WIPO . |
| WO91/02792 | 3/1991 | WIPO . |
| WO91/08171 | 6/1991 | WIPO . |
| WO91/16422 | 10/1991 | WIPO . |
| WO92/06984 | 4/1992 | WIPO . |
| WO93/11215 | 6/1993 | WIPO . |
| WO93/12224 | 6/1993 | WIPO . |
| WO93/16110 | 8/1993 | WIPO . |
| WO95/02675 | 1/1995 | WIPO . |

OTHER PUBLICATIONS

Anal. Biochem. 180:136–39 (1989).

Anal. Biochem. 47:273–79 (1972).

Anal. Biochem. 81:21–27 (1977).

*Primary Examiner*—Kery Fries

*Attorney, Agent, or Firm*—Ernest G. Szoke; Wayne C. Jaeschke; Glenn E. J. Murphy

[57] ABSTRACT

In washing agents containing tensides and cellulase, the properties of the cellulase which are relevant to the application were to be improved. This was essentially achieved in that use was made of a cellulase mixture in which the first component, with a CMCase activity of 1 U per liter and a protein concentration of a most 3 mg per liter, gives an increase in remission of at least 5 units in the secondary washing test and the second component, with a CMCase activity of 20 U per liter gives an increase in absorption in the cellulose decomposition test of at least 0.075.

10 Claims, No Drawings

U.S. PATENT DOCUMENTS

| | | | |
|---|---|---|---|
| 3,547,828 | 12/1970 | Mansfield et al. | 252/351 |
| 3,623,956 | 11/1971 | Kalabokias | 195/66 R |
| 3,623,957 | 11/1971 | Hannah | 219/119 |
| 4,264,738 | 4/1981 | Stepanov et al. | 435/222 |
| 4,372,868 | 2/1983 | Saran et al. | 252/102 |
| 4,585,642 | 4/1986 | Rieck | 423/333 |
| 4,590,237 | 5/1986 | Wuhrmann et al. | 524/480 |
| 4,664,839 | 5/1987 | Rieck | 252/175 |
| 4,820,439 | 4/1989 | Rieck | 252/135 |
| 4,832,866 | 5/1989 | Schulz et al. | 252/321 |
| 4,865,774 | 9/1989 | Fabry et al. | 252/554 |
| 5,002,695 | 3/1991 | Schulz et al. | 252/321 |
| 5,100,796 | 3/1992 | Paridans et al. | 435/198 |
| 5,138,046 | 8/1992 | Wuest et al. | 536/18.6 |
| 5,183,651 | 2/1993 | Schimmel et al. | 423/334 |
| 5,229,095 | 7/1993 | Schimmel et al. | 423/334 |
| 5,236,682 | 8/1993 | Schimmel et al. | 423/334 |
| 5,240,851 | 8/1993 | Paridans et al. | 435/253.3 |
| 5,268,156 | 12/1993 | Schimmel et al. | 423/334 |
| 5,308,596 | 5/1994 | Kotzian et al. | 423/333 |
| 5,356,607 | 10/1994 | Just | 423/334 |
| 5,374,716 | 12/1994 | Biermann et al. | 536/18.6 |
| 5,417,951 | 5/1995 | Just | 423/334 |
| 5,427,936 | 6/1995 | Moeller et al. | 435/198 |
| 5,541,316 | 7/1996 | Engelskirchen et al. | 510/471 |
| 5,576,425 | 11/1996 | Hill et al. | 536/18.6 |
| 5,580,941 | 12/1996 | Krause et al. | 527/300 |
| 5,712,238 | 1/1998 | Chan | 510/367 |
| 5,789,365 | 8/1998 | Blokzijljl et al. | 510/292 |
| 5,789,366 | 8/1998 | Blokzijljl et al. | 510/292 |
| 5,811,381 | 9/1998 | Emalfarb et al. | 510/320 |

CELLULASE-CONTAINING WASHING AGENTS

BACKGROUND OF THE INVENTION

This invention relates to a detergent containing a combination of at least two cellulases, to a washing process using the cellulase combination and to the use of the cellulase combination for the production of detergents.

1. Field of the Invention

Enzymes, particularly proteases, lipases and cellulases, are widely used in detergents, washing aids and cleaners. Whereas proteases and lipases are used primarily for removing protein-containing or fatty soil, cellulases perform a more differentiated function in the washing process.

2. Discussion of the Related Art

By virtue of their ability to degrade cellulose, cellulases have been known for some time as softening agents for cotton fabrics, for example from DE-PS 21 48 278 and from DE-OS 31 17 250. So far as the relevant action mechanism is concerned, it is assumed that fabric-softening cellulases preferentially hydrolyze and remove microfibrous cellulose, so-called fibrils, which project from the surface of the cotton fibers and prevent them from sliding freely over one another. A secondary effect of this degradation of fibrils is intensification of the optical color impression, the so-called freshening of colors described in EP 220 016, which is obtained in the treatment of colored cotton fabrics with cellulases when the uncolored fibrils emanating from damage within the fiber are removed.

On the other hand, other known cellulases are distinguished by the fact that, as described for example in DE-OS 32 07 828, they have a cleaning effect to the extent that they are capable of removing solid inorganic soil from the fabric to be cleaned.

To obtain both these effects of cellulases desirable in the washing process, it has already been proposed on several occasions to use mixtures of cellulases, cf. for example International patent application WO 95/02675. This document is concerned with detergents containing two cellulase components, the first cellulase component having the ability to remove particulate soil and the second cellulase component having color-freshening properties. However, the choice of cellulases according to these criteria leaves important washing-related questions unanswered.

Problem soils which cannot be satisfactorily removed with conventional detergents include cellulose and paper soils. Normally, these soils are only formed during the washing process when paper, for example in the form of banknotes or paper handkerchiefs, remain in and are washed with the laundry to be cleaned, for example in pockets. The problems are attributable to the formation of large visible flocks which adhere to the washing and are not washed out.

The ability to remove soil from the fabric to be cleaned is normally referred to as single wash cycle performance. Besides ingredients with this crucially important property essential to the washing process, detergents also generally contain active substances which contribute towards multiple wash cycle performance. This is understood to be the property whereby soil detached from the fabrics can be kept dissolved or suspended in the wash liquor in such a way that it is not deposited on the cleaned fabric. This effect is also known as anti-redeposition. In the case of detergents, it is desirable that as many of their ingredients as possible, including the cellulase used, contribute towards multiple cycle wash performance through their anti-redeposition effect.

DESCRIPTION OF THE INVENTION

The present invention seeks to provide help in this regard through the use of cellulase mixtures, the first component showing pronounced multiple cycle wash performance and the second component being capable of hydrolyzing cellulose.

It is does not matter whether the components mentioned are pure substances in the sense of chemical individual substances, i.e. in the present case cellulases produced from a single gene, more particularly using genetic processes, or enzyme mixtures such as are present in the majority of commercial cellulases.

In a first embodiment, the present invention relates to detergents containing surfactant and a cellulase mixture of which the first component produces an increase in reflectance in the multiple cycle washing test of at least 5 units and, more particularly, between 5.0 units and 10.0 units for a CMCase activity of 1 U per liter and a protein concentration of at most 3 mg per liter and preferably 0.0001 mg per liter to 0.6 mg per liter and of which the second component produces an increase in absorption in the cellulose degradation test of at least 0.075 for a CMCase activity of 20 U per liter and preferably at a protein concentration of at most 20 mg per liter.

In a second embodiment, the present invention relates to a washing process which is characterized in that a cellulase mixture of which the first component produces an increase in reflectance in the multiple cycle washing test of at least 5 units and, more particularly, between 5.0 units and 10.0 units for a CMCase activity of 1 U per liter and a protein concentration of at most 3 mg per liter and preferably 0.0001 mg per liter to 0.6 mg per liter and of which the second component produces an increase in absorption in the cellulose degradation test of at least 0.075 for a CMCase activity of 20 U per liter and preferably at a protein concentration of at most 20 mg per liter is allowed to act on fabrics in an aqueous, preferably surfactant-containing solution. The detergents according to the invention may be used in this process.

The present invention also relates to a test for finding cellulase mixtures suitable for use in detergents, the first component being determined by carrying out a multiple cycle washing test and selecting a cellulase which produces an increase in reflectance in the multiple cycle washing test of at least 5 units and, more particularly, between 5.0 to 10.0 units for a CMCase activity of I U per liter and at a protein concentration of at most 3 mg per liter and preferably of 0.0001 mg per liter to 0.6 mg per liter and the second component being determined by carrying out the cellulose degradation test and selecting a cellulase which produces an increase in absorption in the cellulose degradation test of at least 0.075 for a CMCase activity of 20 U per liter and preferably at a protein concentration of at most 20 mg per liter.

The protein content of the cellulase components may be determined by the Pierce method as published by R. E. Brown et al. in Anal. Biochem. 180 (1989), 136–139.

Determining the activity of the cellulase components (CMCase activity) is based on modifications of the process described by M. Lever in Anal. Biochem. 47 (1972), 273–279 and in Anal. Biochem. 81 (1977), 21–27. A 2.5% by weight solution of carboxymethyl cellulose (obtained from Sigma, C-5678) in 50 mM glycine buffer (pH 9.0) is used for this purpose. 250 ml of this solution are incubated for 30 minutes at 40° C. with 250 ml of a solution containing the enzyme to be tested. 1.5 ml of a 1% by weight solution of p-hydroxybenzoic acid hydrazide (PAHBAH) in 0.5 M NaOH containing 1 mM bismuth nitrate and 1 mM potassium sodium tartrate is then added and the solution is heated for 10 minutes to 70° C. After cooling (2 minutes, 0° C.), the absorption at 410 nm is measured against a blank value at room temperature (for example using a Uvikon® 930 photometer). The blank value used is a solution which was prepared in the same way as the measuring solution except that both the PAHBAH solution and also the CMC solution were added in that order and heated to 70° C. only after incubation of the enzyme. In this way, any activities of the cellulase with media constituents are also included in the blank value and are deducted from the total activity of the sample so that only the activity towards CMC is actually determined. 1 U corresponds to the quantity of enzyme which produces 1 mmole of glucose per minute under these conditions.

The multiple cycle washing test is carried out using standardized pigment soil (containing 86% kaolin, 8% lamp black 101 from Degussa AG, 4% iron oxide black and 2% iron oxide yellow, both from Henkel Genthin GmbH) and white cotton fabric (manufacturer: Windelbleiche, Krefeld). 19 ml of a soiled liquor containing 0.5% by weight of the described pigment soil and 5 g/l of a bleach- and enzyme-free washing powder, for example consisting of 12% by weight alkyl benzene sulfonate, 9% by weight 3x–5x ethoxylated fatty alcohol, 2% by weight soap, 32% by weight zeolite NaA, 10% by weight trisodium citrate, 12% by weight sodium carbonate, 8% by weight sodium sulfate, 4% by weight dicarboxylic acid mixture (Sokalan® DCS) and 11 % by weight water, is introduced into crystallization dishes (diameter 6 cm) and incubated while shaking (90 r.p.m.) for 30 minutes at pH 8.5/40° C. together with one round piece of the cotton fabric mentioned (diameter 5 cm), which had been prewashed once with the washing powder mentioned at 40° C. and at a concentration of 5 g/l, after the addition of 1 ml of a solution containing 20 U/liter of cellulase. The cotton is then rinsed out in running water and ironed. Using a Dr. Lange Microcolor color measuring instrument, reflectance (expressed as % REF) is determined and the difference in reflectance is worked out by subtracting the reflectance value of a piece of cotton treated in the same way, but without the addition of enzyme. Each piece of cotton is measured at 4 points. Double determinations may be carried out to increase the significance of the reflectance difference values. The composition of the detergent used is not particularly critical because it largely influences the absolute position of the reflectance values and because it is the differences in reflectance between the use of enzyme-free detergent and cellulase-containing detergent rather than the absolute reflectance which are important for the described multiple cycle washing test.

The cellulose degradation test is carried out using pocket tissues (Temp®, manufactured and marketed by VP Chickedanz AG, Nuremberg) from which pieces (one-ply) 5 mm in diameter were punched out. One such round piece of tissue is incubated for 4 hours with 0.9 ml of a wash liquor containing 5.56 g/l of the detergent used in the multiple cycle washing test at pH 8.5/30° C. after addition of 0.1 ml of a solution containing 200 U/liter of cellulase and is then centrifuged (3 minutes, 14,000 r.p.m.). The reducing sugar in the supernatant liquid is determined with PAHBAH, in the same way as described for determination of the CMCase activity, the zero value used being the value of a solution which had been correspondingly treated without any addition of cellulase. The difference in absorption is a measure of the degradation of the cellulose.

The above-described tests for determining multiple cycle wash performance and cellulose degradation have the major advantage over known tests, for example the evaluation process described in European patent application EP 350 098, which is essentially confined to measurement of the cellulolytic degradation of the non-natural substrate carboxymethyl cellulose, that they enable cellulases to be performance-evaluated on the basis of parameters of practical importance, i.e. in a way which can be directly experienced by the end user of the cellulase-containing detergent. For this reason, the results of the tests described above can be directly correlated with practical results from domestic washing or institutional washing. Accordingly, the present invention also relates to a test for selecting cellulase mixtures suitable for use in detergents which is characterized in that a first component is selected for its ability to increase reflectance in the multiple cycle washing test by at least 5 units for a CMCase activity of 1 U per liter and preferably at a protein concentration of at most 0.6 mg per liter and in that a second component is selected for its ability to produce an increase in absorption in the cellulose degradation test of at least 0.075 for a CMCase activity of 20 U per liter, preferably at a protein concentration of 20 mg per liter.

The quantity ratios in which the cellulases selected by the process according to the invention are largely dependent on which of the performances established in the individual test is to be given the greater emphasis in the detergent or washing process. In a preferred embodiment, the ratio by weight of the first component mentioned to the second component mentioned (based on protein) is 1:100 to 1:10 and, more particularly, 1:60 to Detergents containing the cellulase mixture mentioned may also contain any of the other typical constituents of such detergents which do not interact undesirably with the cellulases. It has surprisingly been found that the cellulase mixtures synergistically influence the effect of certain other detergent ingredients and that, conversely, the effect of the cellulose is synergistically enhanced by certain other detergent ingredients. These effects occur in particular with nonionic surfactants, additional enzymes, more particularly proteases and lipases, water-insoluble inorganic builders, water-soluble inorganic and organic builders, particularly those based on oxidized carbohydrates, peroxygen-based bleaching agents, more particularly alkali metal percarbonate, and with synthetic anionic surfactants of the sulfate and sulfonate type except for alkyl benzene sulfonates, so that the ingredients mentioned are preferably used together with the cellulase mixtures.

In one preferred embodiment, a detergent according to the invention contains nonionic surfactant selected from fatty alkyl polyglycosides, fatty alkyl polyalkoxylates, more particularly ethoxylates and/or propoxylates, fatty acid polyhydroxyamides and/or ethoxylation and/or propoxylation products of fatty alkylamines, vicinal diols, fatty acid alkyl esters and/or fatty acid amides and mixtures thereof, more particularly in a quantity of 2% by weight to 25% by weight.

In another embodiment, a detergent according to the invention contains synthetic anionic surfactant of the sulfate and/or sulfonate type, more particularly fatty alkyl sulfate, fatty alkyl ether sulfate, sulfofatty acid esters and/or sulfofatty acid disalts, more particularly in a quantity of 2% by weight to 25% by weight. The anionic surfactant is preferably selected from alkyl or alkenyl sulfates and/or alkyl or alkenyl ether sulfates in which the alkyl or alkenyl group contains 8 to 22 and, more particularly, 12 to 18 carbon atoms.

Suitable nonionic surfactants include the alkoxylates, more particularly the ethoxylates and/or propoxylates, of saturated or mono- to polyunsaturated linear or branched alcohols containing 10 to 22 carbon atoms and preferably 12 to 18 carbon atoms. The degree of alkoxylation of the alcohols is generally between 1 and 20 and preferably between 3 and 10. They may be produced in known manner by reaction of the corresponding alcohols with the corresponding alkylene oxides. Fatty alcohol derivatives are particularly suitable, although branched-chain isomers thereof, more particularly so-called oxoalcohols, may also be used for the production of useful alkoxylates. Accordingly, the alkoxylates and, in particular, the ethoxylates of primary alcohols with linear radicals, more particularly dodecyl, tetradecyl, hexadecyl or octadecyl radicals, and mixtures thereof are suitable. Corresponding alkoxylation products of alkylamines, vicinal diols and carboxylic acid amides, which correspond to the alcohols mentioned in regard to the alkyl moiety, may also be used. Also suitable are the ethylene oxide and/or propylene oxide insertion products of fatty acid alkyl esters, which may be produced by the process described in International patent application WO 90/13533, and the fatty acid polyhydroxyamides obtainable by the processes according to U.S. Pat. No. 1,985,424, U.S. Pat. No. 2,016,962 and U.S. Pat. No. 2,703,798 and to International patent application WO 92/06984. Alkyl polyglycosides suitable for incorporation in the detergents according to the invention are compounds corresponding to the general formula $(G)_n$—$OR^1$, where $R^1$ is an alkyl or alkenyl group containing 8 to 22 carbon atoms, G is a glycose unit and n is a number of 1 to 10. Compounds such as these and their production are described, for example, in European patent applications EP 92 355, EP 301 298, EP 357 969 and EP 362 671 and in U.S. Pat. No. 3,547,828. The glycoside component $(G_n)$ is an oligomer or polymer of naturally occurring aldose or ketose monomers, including in particular glucose, mannose, fructose, galactose, talose, gulose, altrose, allose, idose, ribose, arabinose, xylose and lyxose. The oligomers consisting of these glycosidically linked monomers are determined not only by the type of sugars present in them, but also by the number of sugars present, the so-called degree of oligomerization. As an analytically determined quantity, the degree of oligomerization n is generally a broken number with a value of 1 to 10 and, in the case of the glycosides preferably used, below 1.5 and, more particularly, between 1.2 and 1.4. By virtue of its ready availability, glucose is the preferred monomer unit. The alkyl or alkenyl moiety $R^1$ of the glycosides also preferably emanates from readily available derivatives of renewable raw materials, more particularly from fatty alcohols, although branched-chain isomers thereof, particularly so-called oxoalcohols, may also be used for the production of useful glycosides. Accordingly, primary alcohols containing linear octyl, decyl, dodecyl, tetradecyl, hexadecyl or octadecyl radicals and mixtures thereof are particularly suitable. Particularly preferred alkyl glycosides contain a cocofatty alkyl group, i.e. mixtures with—essentially—$R^1$=dodecyl and $R^1$=tetradecyl.

Nonionic surfactant is present in detergents containing the cellulase mixture in quantities of preferably 1% by weight to 30% by weight and, more preferably, 1% by weight to 25% by weight. Instead of or in addition to these surfactants, such detergents may contain other surfactants, preferably synthetic anionic surfactants of the sulfate or sulfonate type, in quantities of preferably not more than 20% by weight and, more particularly, in quantities of 0.1 % by weight to 18% by weight, based on the detergent as a whole. Synthetic anionic surfactants particularly suitable for use in such detergents are $C_{8-22}$ alkyl and/or alkenyl sulfates containing an alkali, ammonium or alkyl- or hydroxyalkyl-substituted ammonium ion as counter-cation. Derivatives of fatty alcohols containing in particular 12 to 18 carbon atoms and branched-chain analogs thereof, so-called oxoalcohols, are preferred. The alkyl and alkenyl sulfates may be produced in known manner by reaction of the corresponding alcohol component with a typical sulfating agent, more particularly sulfur trioxide or chlorosulfonic acid, and subsequent neutralization with alkali, ammonium or alkyl- or hydroxyalkyl-substituted ammonium bases. The alkyl and/or alkenyl sulfates are present in the detergents according to the invention in quantities of preferably 0.1 % by weight to 20% by weight and, more preferably, 0.5% by weight to 18% by weight.

Suitable surfactants of the sulfate type also include sulfated alkoxylation products of the alcohols mentioned, so-called ether sulfates. Ether sulfates preferably contain 2 to 30 and, more particularly, 4 to 10 ethylene glycol groups per molecule. Suitable anionic surfactants of the sulfonate type include the α-sulfoesters obtainable by reaction of fatty acid esters with sulfur trioxide and subsequent neutralization, more particularly the sulfonation products derived from fatty acids containing 8 to 22 and preferably 12 to 18 carbon atoms and linear alcohols containing 1 to 6 and preferably 1 to 4 carbon atoms, and the sulfofatty acids obtainable therefrom by formal saponification.

Other optional surface-active ingredients are soaps, saturated fatty acid soaps, such as the salts of lauric acid, myristic acid, palmitic acid or stearic acid, and soaps derived from natural fatty acid mixtures, for example cocofatty acid, palm kernel oil fatty acid or tallow fatty acid. Soap mixtures of which 50% by weight to 100% by weight consist of saturated $C_{12-18}$ fatty acid soaps and up to 50% by weight of oleic acid soap are particularly preferred. Soap is preferably present in quantities of 0.1 % by weight to 5% by weight. However, larger quantities of soap of generally up to 20% by weight may also be present, particularly in liquid detergents according to the invention.

In another embodiment, a detergent according to the invention contains water-soluble and/or water-insoluble builders, more particularly selected from alkali metal alumosilicate, crystalline alkali metal silicate with a modulus of >1, monomeric polycarboxylate, polymeric polycarboxylate and mixtures thereof, more particularly in quantities of 2.5% by weight to 60% by weight.

A detergent according to the invention preferably contains 20% by weight to 55% by weight of water-soluble and/or water-insoluble, organic and/or inorganic builders. Water-soluble organic builders include in particular those from the class of polycarboxylic acids, more particularly citric acid and sugar acids, and polymeric (poly)carboxylic acids, more particularly the polycarboxylates obtainable by oxidation of polysaccharides according to International patent application WO 93/16110, polymeric acrylic acids, methacrylic acids, maleic acids and copolymers thereof, which may also contain small amounts of polymerizable substances with no carboxylic acid functionality in copolymerized form. The relative molecular weight of the homopolymers of unsaturated carboxylic acids is generally between 5,000 and 200,000 while the relative molecular weight of the copolymers is between 2,000 and 200,000 and preferably between 50,000 and 120,000, based on free acid. A particularly preferred acrylic acid/maleic acid copolymer has a relative molecular weight of 50,000 to 100,000. Suitable but less preferred compounds of this class are copolymers of acrylic acid or methacrylic acid with vinyl ethers, such as vinyl methyl ethers, vinyl ester, ethylene, propylene and styrene, in which the percentage content of the acid is at least 50% by weight. Other suitable water-soluble organic builders are terpolymers which contain two unsaturated acids and/or salts thereof as monomers and vinyl alcohol and/or a vinyl alcohol derivative or a carbohydrate as the third monomer. The first acidic monomer or its salt is derived from a monoethylenically unsaturated $C_{3-8}$ carboxylic acid and preferably from a $C_{3-4}$ monocarboxylic acid, more particularly (meth)acrylic acid. The second monomer or its salt may be a derivative of a $C_{4-8}$ dicarboxylic acid, preferably a $C_{4-8}$ dicarboxylic acid, maleic acid being particularly preferred. In this case, the third monomeric unit is formed by vinyl alcohol and/or preferably by an esterified vinyl alcohol. Vinyl alcohol derivatives containing an ester of short-chain carboxylic acids, for example $C_{1-4}$ carboxylic acids, with vinyl alcohol are particularly preferred. Preferred terpolymers contain 60% by weight to 95% by weight and more particularly 70% by weight to 90% by weight of (meth) acrylic acid or (meth)acrylate, preferably acrylic acid or acrylate, and maleic acid or maleate and 5% by weight to 40% by weight and preferably 10% by weight to 30% by weight of vinyl alcohol and/or vinyl acetate. Terpolymers in which the ratio by weight of (meth)acrylic acid or (meth) acrylate to maleic acid or maleate is between 1:1 and 4:1, preferably between 2:1 and 3:1 and more preferably between 2:1 and 2.5:1 are most particularly preferred (both the quantities and the ratios by weight are based on the acids). The second acidic monomer or its salt may also be a derivative of an allyl sulfonic acid which is substituted in the 2-position by an alkyl group, preferably by a $C_{14}$ alkyl group, or by an aromatic group preferably derived from benzene or benzene derivatives. Preferred terpolymers contain 40% by weight to 60% by weight and, more particularly, 45 to 55% by weight of (meth)acrylic acid or (meth)acrylate, preferably acrylic acid or acrylate, 10% by weight to 30% by weight and preferably 15% by weight to 25% by weight of methallyl sulfonic acid or methallyl sulfonate and, as the third monomer, 15% by weight to 40% by weight and preferably 20% by weight to 40% by weight of a carbohydrate. This carbohydrate may be, for example, a mono-, di-, oligo- or polysaccharide, mono-, di- or oligosaccharides being preferred and sucrose being particularly preferred. Weakened points responsible for the ready biodegradability of the polymer are presumably incorporated therein through the use of the third monomer. These terpolymers may be produced in particular by the processes described in German patent DE 42 21 381 and in German patent application DE 43 00 772 and have a relative molecular weight of generally from 1,000 to 200,000, preferably from 200 to 50,000 and more preferably from 3,000 to 10,000. They may be used in the form of aqueous solutions, preferably in the form of 30 to 50% by weight aqueous solutions, particularly for the production of liquid detergents. All the polycarboxylic acids mentioned are generally used in the form of their water-soluble salts, particularly their alkali metal salts.

Organic builders of the type in question are preferably present in quantities of up to 40% by weight, more preferably in quantities of up to 25% by weight and most preferably in quantities of 1% by weight to 5% by weight. Quantities near the upper limit mentioned are preferably used in paste-form or liquid, more particularly water-containing, detergents in which the cellulase mixture is present.

Suitable water-insoluble, water-dispersible inorganic builders are, in particular, crystalline or amorphous alkali metal alumosilicates used in quantities of up to 50% by weight, preferably in quantities of not more than 40% by weight and—in liquid detergents in particular—in quantities of 1% by weight to 5% by weight. Of these builders, detergent-quality crystalline alumosilicates, particularly zeolite NaA and optionally NaX, are preferred. Quantities near the upper limit mentioned are preferably used in solid particulate detergents. Suitable alumosilicates contain no particles larger than 30% $\mu$m in size, at least 80% by weight preferably consisting of particles below 10 $\mu$m in size. Their calcium binding capacity which may be determined in accordance with German patent DE 24 12 387 is in the range from 100 to 200 mg CaO per gram. Suitable substitutes or partial substitutes for the alumosilicate mentioned are crystalline alkali metal silicates which may be present either individually or in the form of a mixture with amorphous silicates. The alkali metal silicates suitable as builders in the detergents preferably have a molar ratio of alkali metal oxide to $SiO_2$ of less than 0.95:1 and, more particularly, from 1:1.1 to 1:12 and may be present in amorphous or crystalline form. Preferred alkali metal silicates are sodium silicates, more particularly amorphous sodium silicates, with a molar $Na_2O:SiO_2$ ratio of 1:1 to 1:2.8. Amorphous alkali metal silicates such as these are commercially available, for example under the name of Portil®. Those with a molar $Na_2O:SiO_2$ ratio of 1:1.9 to 1:2.8 may be produced by the process according to European patent application EP 0 425 427. They are preferably added in solid form rather than in the form of a solution. Preferred crystalline silicates, which may be present either individually or in the form of a mixture with amorphous silicates, are crystalline layer silicates with the general formula $Na_2Si_xO_{2x+1}\Omega yH_2O$, in which x, the so-called modulus, is a number of 1.9 to 4 and y is a number of 0 to 20, preferred values for x being 2, 3 or 4. Crystalline layer silicates which correspond to this general formula are described, for example, in European patent application EP 0 164 514. Preferred crystalline layer silicates are those in which x in the general formula shown above assumes a value of 2 or 3. Both β- and δ-sodium disilicates ($Na_2Si_2O_5\Omega yH_2O$) are particularly preferred, β-sodium disilicate being obtainable for example by the process described in International patent application WO 91/08171. δ-Sodium silicates with a modulus of 1.9 to 3.2 may be produced in accordance with Japanese patent applications JP 04/238 809 or JP 041260 610. Substantially water-free crystalline alkali metal silicates produced from amorphous alkali metal silicates and corresponding to the above general formula where x is a number of 1.9 to 2.1, obtainable as described in European patent applications EP 0 548 599, EP 0 502 325 and EP 0 452 428, may also be used in detergents according to the invention. Another preferred embodiment of a detergent according to the invention is characterized by the use of a crystalline sodium layer silicate with a modulus of 2 to 3 which may be obtained from sand and soda by the process according to European patent application EP 0 436 835. Crystalline sodium silicates with a modulus of 1.9 to 3.5, which may be obtained by the processes according to European patent EP 0 164 552 and/or European patent application EP 0 294 753, are used in another preferred embodiment of detergents according to the invention. Their alkali metal silicate content is preferably from 1 % by weight to 50% by weight and more preferably from 5% by weight to 35% by weight, based on water-free active substance. If alkali metal alumosilicate, more particularly zeolite, is also present as an additional builder, the alkali metal silicate content is preferably from 1% by weight to 15% by weight and more preferably from 2% by weight to 8% by weight, based on water-free active substance. In that case, the ratio by weight of alumosilicate to silicate, based on water-free active substances, is preferably from 4:1 to 10:1. In detergents containing both amorphous and crystalline alkali metal silicates, the ratio by weight of amorphous alkali metal silicate to crystalline alkali metal silicate is preferably 1:2 to 2:1 and more preferably 1:1 to 2:1.

In addition to the inorganic builder mentioned, other water-soluble or water-insoluble inorganic substances may be used in detergents according to the invention. Alkali metal carbonates, alkali metal hydrogen carbonates and alkali metal sulfates and mixtures thereof are suitable in this regard. This additional inorganic material may be present in quantities of up to 70% by weight, but is preferably absent altogether.

The detergents may additionally contain other constituents typically encountered in detergents and cleaners. These optional constituents include, in particular, other enzymes, enzyme stabilizers, bleaching agents, bleach activators, heavy metal complexing agents, for example aminopolycarboxylic acids, aminohydroxypolycarboxylic acids, polyphosphonic acids and/or aminopolyphosphonic acids, redeposition inhibitors, for example cellulose ethers, dye transfer inhibitors, for example polyvinyl pyrrolidone or polyvinyl pyridine-N-oxide, foam inhibitors, for example organopolysiloxanes or paraffins, so-called soil release agents, for example polymers based on terephthalic acid, polyglycols and glycols, solvents, fabric softeners, for example from the class of quaternary ammonium compounds or clays, and optical brighteners, for example stilbene disulfonic acid derivatives. Detergents according to the invention preferably contain up to 1% by weight and, more particularly, 0.01% by weight to 0.5% by weight of optical brighteners, more particularly compounds from the class of substituted 4,4'-bis-(2,4,6-triamino-s-triazinyl)-stilbene-2,2'-disulfonic acids, up to 15% by weight and, more particularly, 0.5% by weight to 10% by weight of fabric softeners, up to 5% by weight and, more particularly 0.1% by weight to 2% by weight of heavy metal complexing agents, more particularly aminoalkylene phosphonic acids and salts thereof, up to 3% by weight and, more particularly, 0.5% by weight to 2% by weight of redeposition inhibitors, up to 3% by weight and, more particularly, 0.5% by weight to 2% by weight of soil release agents and up to 2% by weight and, more particularly, 0.1% by weight to 1% by weight of foam inhibitors, the percentages by weight mentioned all being based on the detergent as a whole.

Besides water, preferred solvents, which may be used in particular in liquid detergents according to the invention, are water-miscible solvents. These include lower alcohols, for example ethanol, propanol, isopropanol and the isomeric butanols, glycerol, lower glycols, for example ethylene and propylene glycol, and the ethers derived from compounds belonging to the classes mentioned.

Additional enzymes optionally present are preferably selected from the group consisting of protease, amylase, lipase, hemicellulase, oxidase, peroxidase or mixtures thereof. Protease obtained from microorganisms, such as bacteria or fungi, is particularly suitable. It may be obtained by known fermentation processes from suitable microorganisms which are described, for example, in DE-OSS 19 40 488, 20 44 161, 22 01 803 and 21 21 397, in US-PSS 3,632,957 and 4,264,738, in European patent application EP 006 638 and in International patent application WO 91/02792. Proteases are commercially available, for example, under the names of BLAP®, Savinase®, Esperase®, Maxatase®, Optimase®, Alcalase®, Durazym® or Maxapem®. The lipase suitable for use in accordance with the invention may be obtained from *Humicola lanuginosa,* as described for example in European patent applications EP 258 068, EP 305 216 and EP 341 947, from *bacillus* species, as described for example in International patent application WO 91/16422 or European patent application EP 384 717, from *pseudomonas* species, as described for example in European patent applications EP 468 102, EP 385 401, EP 375 102, EP 334 462, EP 331 376, EP 330 641, EP 214 761, EP 218 272 or EP 204 284 or in International patent application WO 90110695, from *fusarium* species, as described for example in European patent application EP 130 064, from *rhizopus* species, as described for example in European patent application EP 117 553, or from *aspergillus* species, as described for example in European patent application EP 167 309. Suitable lipases are commercially available, for example under the names of Lipolase®, Lipozym®, Lipomax, Amano® Lipase, Toyo Jozo® Lipase, Meito® Lipase and Diosynth® Lipase. The amylase used may be an enzyme obtainable from bacteria or fungi which has an optimum pH preferably in the mildly acidic to mildly alkaline range of 6 to 9.5. Suitable amylases are commercially available, for example, under the names of Maxamyl® and Termamyl®.

Typical enzyme stabilizers which may optionally be present, particularly in liquid detergents, include amino alcohols, for example mono-, di-, tri-ethanolamine and -propanolamine and mixtures thereof, lower carboxylic acids as known, for example, from European patent applications EP 376 705 and EP 378 261, boric acid and alkali metal borates, boric acid/carboxylic acid combinations as known, for example, from European patent application EP 451 921, boric acid esters as known, for example, from International patent application WO 93/11215 or European patent application EP 511 456, boric acid derivatives as known, for example, from European patent application EP 583 536, calcium salts, for example the calcium/formic acid combination known from European patent EP 28 865, magnesium salts as known, for example, from European patent application EP 378 262 and/or sulfur-containing reducing agents as known, for example, from European patent applications EP 080 748 or EP 080 223.

Suitable foam inhibitors include long-chain soaps, more particularly behenic soap, fatty acid amides, paraffins, waxes, microcrystalline waxes, organopolysiloxanes and mixtures thereof which may additionally contain microfine, optionally silanized or otherwise hydrophobicized silica. For use in particulate detergents, these foam inhibitors are preferably fixed to granular water-soluble supports, as described for example in DE-OS 34 36 194, in European patent applications EP 262 588, EP 301 414 or EP 309 931 or in European patent EP 150 386.

A detergent according to the invention may also contain additional redeposition inhibitors. Water-soluble, generally organic colloids are suitable for this purpose, including for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example partly hydrolyzed starch, may also be used. Sodium carboxymethyl cellulose, methyl cellulose, methyl hydroxyethyl cellulose and mixtures thereof are preferably used.

Another embodiment of a detergent according to the invention contains peroxygen-based bleaching agents, more particularly in quantities of 5% by weight to 70% by weight, and optionally bleach activators, more particularly in quantities of 2% by weight to 10% by weight. Suitable bleaching agents are the per compounds generally used in detergents, such as hydrogen peroxide, perborate (which may be present as tetra- or monohydrate), percarbonate, perpyrophosphate and persilicate which are generally present as alkali metal salts, more particularly as sodium salts. Such bleaching agents are present in detergents according to the invention in quantities of preferably up to 25% by weight, more preferably in quantities of up to 15% by weight and most preferably in quantities of 5% by weight to 15% by weight, based on the detergent as a whole. The optional bleach activator component may be selected from the N- or O-acyl compounds normally used, for example polyacylated alkylenediamines, more particularly tetraacetyl ethylenediamine, acylated glycolurils, more particularly tetraacetyl glycoluril, N-acylated hydantoins, hydrazides, triazoles, urazoles, diketopiperazines, sulfuryl amides and cyanurates, and from carboxylic anhydrides, more particularly phthalic anhydride, carboxylic acid esters, more particularly sodium isononanoyl phenol sulfonate, and acylated sugar derivatives, more particularly pentaacetyl glucose. To avoid interaction with the per compounds in storage, the bleach activators may be coated or granulated in known manner with shell-forming substances, tetraacetyl ethylenediamine granulated with carboxymethyl cellulose and having average particle sizes of 0.01 mm to 0.8 mm, which may be produced for example by the process described in European patent EP 37 026, and/or granulated 1,5-diacetyl-2,4-dioxohexahydro-1,3,5-triazine, which can be produced by the process described in East German patent DD 255 884, being particularly preferred. The bleach activators in question are present in detergents in quantities of preferably up to 8% by weight and more preferably in quantities of 2% by weight to 6% by weight, based on the detergent as a whole.

In one preferred embodiment, a detergent according to the invention is particulate and contains 20% by weight to 55% by weight of inorganic builder, up to 15% by weight and more particularly from 2% by weight to 12% by weight of water-soluble organic builder, 2.5% by weight to 20% by weight of synthetic anionic surfactant, 1% by weight to 20% by weight of nonionic surfactant, up to 25% by weight and more particularly from 1% by weight to 15% by weight of bleaching agent, up to 8% by weight and more particularly from 0.5% by weight to 6% by weight of bleach activator and up to 20% by weight and more particularly from 0.1% by weight to 15% by weight of inorganic salts, more particularly alkali metal carbonate and/or sulfate.

In another preferred embodiment, a powder-form detergent such as this, more particularly for use as a light-duty detergent, contains 20% by weight to 55% by weight of inorganic builder, up to 15% by weight and more particularly from 2% by weight to 12% by weight of water-soluble organic builder, from 4% by weight to 24% by weight of nonionic surfactant, up to 15% by weight and more particularly from 1% by weight to 10% by weight of synthetic anionic surfactant, up to 65% by weight and more particularly from 1% by weight to 30% by weight of inorganic salts, more particularly alkali metal carbonate and/or sulfate, and neither bleaching agents nor bleach activators.

Another preferred embodiment is a liquid detergent containing from 5% by weight to 35% by weight of water-soluble organic builder, up to 15% by weight and more particularly from 0.1 to 5% by weight of water-insoluble inorganic builder, up to 15% by weight and more particularly from 0.5% by weight to 10% by weight of synthetic anionic surfactant, from 1% by weight to 25% by weight of nonionic surfactant, up to 15% by weight and more particularly from 4% by weight to 12% by weight of soap and up to 30% by weight and more particularly from 1% by weight to 25% by weight of water and/or water-miscible solvent.

EXAMPLES

Example 1

Results of the multiple cycle washing test

The multiple cycle washing test described above was carried out using a detergent consisting of 12% by weight of alkyl benzene sulfonate, 9% by weight of 3x to 5x ethoxylated fatty alcohol, 2% by weight of soap, 32% by weight of zeolite NaA, 10% by weight of trisodium citrate, 12% by weight of sodium carbonate, 8% by weight of sodium sulfate, 4% by weight of dicarboxylic acid mixture (Sokalan®) DCS) and 11 % by weight of water. The reflectance difference (delta REM) values shown in Table 1 (averages of two determinations) were obtained for various cellulases. It is clear from the protein concentrations (in mg/l) also shown in Table I that Celluzyme® does not remotely satisfy the requirements for the first component of the cellulase mixture.

TABLE 1

Reflectance Difference in the Multiple Cycle Washing Test

| Cellulase | Delta REM | Protein Concentration |
|---|---|---|
| Celluzyme ® 0.7T[a)] | 5.0 | 5.4 |
| N1-Cellulase[b)] | 6.2 | <0.5 |
| N4-Cellulase[c)] | 5.0 | <0.5 |

[a)]A commercial product of Novo Nordisk
[b)]Isolated from the bacillus strain deposited in the American Type Culture Collection under number ATTC 21832, as described in DE-OS 2 247 832
[c)]Isolated from the bacillus strain deposited in the American Type Culture Collection under number ATTC 21833, as described in DE-OS 2 247 832.

Example 2

Results of the cellulose degradation test

The cellulose degradation test described above was carried out using various cellulases. The absorption difference (delta A) results shown in Table 1 (averages of two determinations) were obtained. It can be seen that both cellulases meet the criteria for a second cellulase component according to the invention.

TABLE 1

Absorption Difference in the Cellulose Degradation Test

| Cellulase | Delta A |
|---|---|
| Celluzyme ® 0.7T[a)] | 0.236 |
| Denimax ® ultra[b)] | 0.084 |

[a)]Commercial product of Novo Nordisk
[b)]Commercial product of Novo Nordisk

We claim:

1. A detergent comprising a surfactant and a mixture of cellulases, said mixture comprising a first cellulase component that with a CMCase activity of 1 U/liter and a protein concentration of at most 3 mg/liter produces an increase in reflectance in the multiple cycle washing test of at least 5 units and a second cellulase component that with a CMCase activity of 20 U/liter produces an increase in absorption in the cellulase degradation test of at least 0.075.

2. A detergent according to claim 1, wherein the first cellulase component with a protein concentration of 0.0001 mg/liter to 0.6 mg/liter produces an increase in reflectance in the multiple cycle washing test of at least 5 units.

3. A detergent according to claim 2, wherein the first cellulase component produces an increase in reflectance in the multiple cycle washing test of 5 to 10 units.

4. A detergent according to claim 3, wherein the second cellulase component has a protein concentration of at most 20 mg/liter.

5. A detergent according to claim 1, wherein the weight ratio of the first cellulase component to the second cellulase component is from 1:100 to 1:10.

6. A detergent according to claim 5, wherein the weight ratio is from 1:60 to 1:20.

7. A process for washing a fabric, comprising contacting a fabric with an aqueous solution of a mixture of cellulases, said mixture comprising a first cellulase component that with a CMCase activity of 1 U/liter and a protein concentration of at most 3 mg/liter produces an increase in reflectance in the multiple cycle washing test of at lease 5 units and a second cellulase component that with a CMCase activity of 20 U/liter produces an increase in absorption in the cellulase degradation test of at least 0.075.

8. A process according to claim 7, wherein the weight ratio of the first cellulase component to the second cellulase component is from 1:100 to 1:10.

9. A process according to claim 8, wherein the weight ratio is from 1:60 to 1:20.

10. A method of identifying cellulase mixtures suitable for use in detergents, comprising selecting a first cellulase component that produces an increase in reflectance in the multiple cycle washing test of at least 5 units with a CMCase activity of 1 U/liter and a protein concentration of at most 3 mg/liter and selecting a second cellulase component that produces an increase in absorption in the cellulase degradation test of at least 0.075 with a CMCase activity of 20 U/liter.

* * * * *